US009487974B2

(12) United States Patent
Saitou

(10) Patent No.: US 9,487,974 B2
(45) Date of Patent: Nov. 8, 2016

(54) SWITCH DEVICE AND VEHICLE DOOR OUTER HANDLE SYSTEM

(75) Inventor: Tadashi Saitou, Miyazaki (JP)

(73) Assignee: KABUSHIKI KAISHA HONDA LOCK, Miyazaki (JP)

( * ) Notice: Subject to any disclaimer, the term of this patent is extended or adjusted under 35 U.S.C. 154(b) by 563 days.

(21) Appl. No.: 13/570,072

(22) Filed: Aug. 8, 2012

(65) Prior Publication Data

US 2013/0048482 A1 Feb. 28, 2013

(30) Foreign Application Priority Data

Aug. 30, 2011 (JP) ..... 2011-186797

(51) Int. Cl.

| | |
|---|---|
| ***H01H 3/12*** | (2006.01) |
| ***H01H 13/14*** | (2006.01) |
| ***E05B 81/76*** | (2014.01) |
| ***H01H 13/04*** | (2006.01) |
| ***H01H 13/06*** | (2006.01) |
| ***E05B 85/16*** | (2014.01) |
| *H01H 9/06* | (2006.01) |
| *H01H 9/04* | (2006.01) |

(52) U.S. Cl.

CPC ..... *E05B 81/76* (2013.01); *E05B 85/16* (2013.01); *H01H 13/04* (2013.01); *H01H 13/06* (2013.01); *H01H 9/06* (2013.01); *H01H 2009/048* (2013.01)

(58) Field of Classification Search

CPC ..... H01H 9/04; H01H 9/041; H01H 13/06; H01H 13/063; H01H 13/14

USPC ..... 200/302.1, 302.2, 341, 513

See application file for complete search history.

(56) References Cited

U.S. PATENT DOCUMENTS

| | | | | |
|---|---|---|---|---|
| 5,824,978 | A * | 10/1998 | Karasik et al. | 200/18 |
| 6,626,473 | B1 * | 9/2003 | Klein et al. | 292/347 |
| 7,057,124 | B2 | 6/2006 | Ieda et al. | |
| 7,273,991 | B2 | 9/2007 | Korultay et al. | |

(Continued)

FOREIGN PATENT DOCUMENTS

| | | |
|---|---|---|
| CN | 1354815 A | 6/2002 |
| CN | 1571087 A | 1/2005 |

(Continued)

OTHER PUBLICATIONS

JP Office Action, Japanese Application No. 2011-186797 dated Dec. 25, 2013.

(Continued)

*Primary Examiner* — Renee Luebke
*Assistant Examiner* — Lheiren Mae A Caroc
(74) *Attorney, Agent, or Firm* — Arent Fox LLP

(57) ABSTRACT

A switch device includes: a switch housing case; a holder fixedly placed inside the case; a switch fixedly housed inside the holder; and multiple switch buttons each capable of making pressing force act on the switch. An intermediate cap integrally including a lid portion covering the switch and a tubular portion continuing to a peripheral edge portion of the lid portion is attached to the holder. A first deformation portion on the tubular portion deforms the tubular portion by pressing on the lid portion from a first switch button. A second deformation portion on the lid portion deforms a center portion of the lid portion by pressing on the center portion of the lid portion from a second switch button. Two types of switch buttons without making changes to the parts exclusive of the switch buttons becomes possible.

4 Claims, 7 Drawing Sheets

(56) References Cited

U.S. PATENT DOCUMENTS

| | | | | |
|---|---|---|---|---|
| 8,469,412 | B2 | 6/2013 | Mizushima et al. | |
| 8,575,506 | B2 * | 11/2013 | Kitahara et al. | 200/341 |
| 2010/0072050 | A1 | 3/2010 | Kubota | |
| 2011/0308925 | A1 * | 12/2011 | Kitahara | 200/302.2 |

FOREIGN PATENT DOCUMENTS

| | | | |
|---|---|---|---|
| CN | 1823207 | A | 8/2006 |
| CN | 101663449 | A | 3/2010 |
| JP | 53-127281 | U | 10/1978 |
| JP | 02-150623 | U | 12/1990 |
| JP | 09-1678 | A | 1/1997 |
| JP | 2003-257274 | A | 9/2003 |
| JP | 2004-111258 | A | 4/2004 |
| JP | 2004-169427 | A | 6/2004 |
| JP | 2006-004891 | A | 1/2006 |
| JP | 2006-093062 | A | 4/2006 |
| JP | 2008-047347 | A | 2/2008 |
| JP | 4211471 | B2 | 11/2008 |
| JP | 2009-104804 | A | 5/2009 |
| JP | 2010-080234 | A | 4/2010 |

OTHER PUBLICATIONS

Chinese Office Action dated May 29, 2014 issued in Chinese Patent Application No. 201210316647.6.

* cited by examiner

SWITCH DEVICE AND VEHICLE DOOR OUTER HANDLE SYSTEM

BACKGROUND OF THE INVENTION

1. Field of the Invention

The present invention relates to: a switch device designed to turn on and off in accordance with press manipulation; and a vehicle door outer handle system in which the switch device is installed.

2. Description of the Related Art

Among switch devices, there is one which includes: a switch housing case having an opening portion; a holder having a tubular holder main portion and being fixedly placed inside the switch housing case in a position corresponding to the opening portion, at least one end on the opening portion side of the holder main portion being opened; a switch including a portion to he pressed, and housed in and fixed to the inside of the holder main portion of the holder in a way that changes a switching mode in accordance with action of pressing force on the portion to be pressed; and a switch button including a press manipulation portion which is placed inside the opening portion, being capable of operating in a way that makes the pressing force act on the switch in accordance with manipulation of the press manipulation portion, and being placed in a way that covers one end portion of the holder main portion. In addition, Japanese Patent No. 4211471 makes known a switch device in which: a switch case, in which a switch is housed, is fixedly placed inside a vehicle door outer handle; a switch cap covering the switch is attached to the switch case; and a switch button configured to cause pressing force to act on the switch through the switch cap is supported by the outer handle.

The switch device disclosed in Japanese Patent No. 4211471 is designed in a way that: the center portion of the switch button made of rubber material, whose outer peripheral portion is fixedly supported by the outer handle, deforms toward the switch due to the action of the press manipulation force; and the pressing force from the switch button acts on the switch through the switch cap. On the other hand; a switch button made of hard synthetic resin is desirably used rather than the rubber-made switch button in terms of design. In such a case, when the press manipulation force acts on the switch button, the switch button moves as a whole and applies the pressing force on the switch. In a case where either of the two types of switch buttons whose operational modes are different from each other as mentioned above is intended to be selectively used, the choice between the two types of switch buttons can be easily made if no changes need to be made to the parts exclusive of the switch buttons, leading to enhancement of the design quality.

SUMMARY OF THE INVENTION

The present invention has been made in consideration of the foregoing situation. An object of the present invention is to provide: a switch device capable of dealing with two types of switch buttons without making changes to the parts exclusive of the switch buttons; and a vehicle door outer handle system using the switch device.

In order to achieve the object, according to a first feature of the present invention, there is provided a switch device comprising: a switch housing case having an opening portion; a holder including a tubular holder main portion and being fixedly placed inside the switch housing case in a position corresponding to the opening portion, at least one end, on the opening portion side, of the holder main portion being opened; a switch including a portion to be pressed, and housed in and fixed to the inside of the holder main portion of the holder in a way that changes a switching mode in accordance with action of pressing force on the portion to be pressed; and any one of switch buttons each of which includes a press manipulation portion being placed inside the opening portion, is capable of operating in a way that makes the pressing force act on the switch in accordance with manipulation of the press manipulation portion, and is placed in a way that covers one end portion of the holder main portion, wherein the holder is fixed to the inside of the switch housing case with the one end portion of the holder main portion opposed to an inner surface of a peripheral edge portion of the opening portion, an intermediate cap made of elastic material is attached to the holder in a way that closes one end of the holder main portion and integrally includes a lid portion and a tubular portion, the lid portion being capable of causing the pressing force to act on the portion to be pressed and covering the switch, the tubular portion continuing to a peripheral edge portion of the lid portion, the tubular portion includes a first deformation portion configured to deform the tubular portion in a way that makes the entirety of the lid portion press the switch in accordance with the action of the pressing force on the lid portion from a first one of the switch buttons, the first switch button having a first collar portion at an outer periphery of one end portion, on the holder side, of the first switch button, the first collar portion being capable of moving between the one end portion of the holder main portion and the inner surface of the peripheral edge portion of the opening portion, the lid portion includes a second deformation portion configured to deform a center portion of the lid portion in a way that makes the center portion of the lid portion press the switch in accordance with the action of the pressing force on the center portion of the lid portion from a second one of the switch buttons, the second switch button having a second collar portion at an outer periphery of one end portion, on the holder side, of the second switch button, the second collar portion held between and by the one end portion of the holder main portion and the inner surface of the peripheral edge portion of the opening portion.

According to the first feature of the present invention, the holder including the tubular holder main portion, which the switch is housed in and fixed to, is fixed to the inside of the switch housing case with the one end portion of the holder main portion opposed to the inner surface of the peripheral edge portion of the opening portion provided in the switch housing case; the intermediate cap which is made of elastic material and integrally includes the lid portion covering the switch and the tubular portion continuing to the peripheral edge portion of the lid portion, is attached to the holder; the first collar portion included in the first: switch button is movable between the one end portion of the holder main portion and the inner surface of the peripheral edge portion of the opening portion; the second collar portion included in the second switch button is held between and by the one end portion of the holder main portion and the inner surface of the peripheral edge portion of the opening portion; the tubular portion is provided with the first deformation portion which is configured to deform the tubular portion in the way that makes the entirety of the lid portion press the switch in accordance with the action of the pressing force on the lid portion from the first switch button the entirety of which moves in accordance with the press manipulation to the press manipulation portion; and the lid portion is provided with the second deformation portion which is configured to deform the center portion of the lid portion in the way that makes the center portion of the lid portion press the switch in accordance with the action of the pressing force on the center portion of the lid portion from the press manipulation portion of the second switch button in accordance with the press manipulation. For these reasons, it is possible to deal with the two types of switch buttons, namely, the first switch button the entirety of which moves in accordance with the press manipulation, and the second switch button in which only the press manipulation portion deforms in accordance with the press manipulation, without making changes to the parts exclusive of these switch buttons. Accordingly, it is possible to enhance the design quality.

According to a second feature of the present invention, in addition to the first feature, an end portion of the intermediate cap opposite from the lid portion is inserted into and joined to the one end portion of the holder main portion included in the holder by engaging recess and protrusion of the end portions with each other, the intermediate cap and the holder made of synthetic resin.

According to the second feature of the present invention, the end portion of the intermediate cap opposite from the lid portion is inserted in and joined to the one end portion of the holder main portion included in the holder, and the intermediate cap and the holder main portion engage with each other in the way that engages their recess and protrusion with each other. For these reasons, even if a gap should occur in the joining portion between the intermediate cap and the holder main portion, the gap is labyrinthine. Accordingly, it is possible to suppress the entrance of water from the outside of the holder to the switch within the holder.

According to a third feature of the present invention, in addition to the second feature, the intermediate cap and the holder are made of materials in combination which enable the intermediate cap and the holder to get into close contact with each other due to hydrogen bond.

According to the third feature of the present invention, the intermediate cap and the holder get into close contact with each other due to the hydrogen bond. For this reason, it is possible to more securely prevent water from entering the inside of the holder.

According to a fourth feature of the present invention, there is provided a vehicle door outer handle system in which at least one of locking and unlocking of a door is carried out by use of the switch device according to any one of the first to third features, wherein the switch device is constructed by using any one of a manipulation handle and a base member as the switch housing case, the manipulation handle including a grip portion which is placed on an outside of an outer panel constituting part of the door and is formed long, the base member being attached to the outer panel corresponding to an end portion of the manipulation handle.

According to the fourth feature of the present invention, the switch device is constructed by using, as the switch housing case, one of the manipulation handle and the base member which is attached to the outer panel to correspond to the end portion of the manipulation handle. For this reason, the switch device of the present invention can be adequately used for the vehicle door outer handle system.

The above and other objects, characteristics and advantages of the present invention will be clear from detailed descriptions of the preferred embodiment which will be provided below while referring to the attached drawings.

DESCRIPTION OF THE PREFERRED EMBODIMENT

Descriptions will be hereinbelow provided for an embodiment of the present invention while referring to FIG. 1 to FIG. 7. At first, referring to FIG. 1, one end portion (a front end portion) of a door D provided to this passenger vehicle, for example a front side door, is rotatably supported by a vehicle body B. A door mirror 11 is placed in a front portion of the door D. In addition, an outer handle system 12 is installed in the other end side, namely a rear end side, of the door D.

Figure 1:
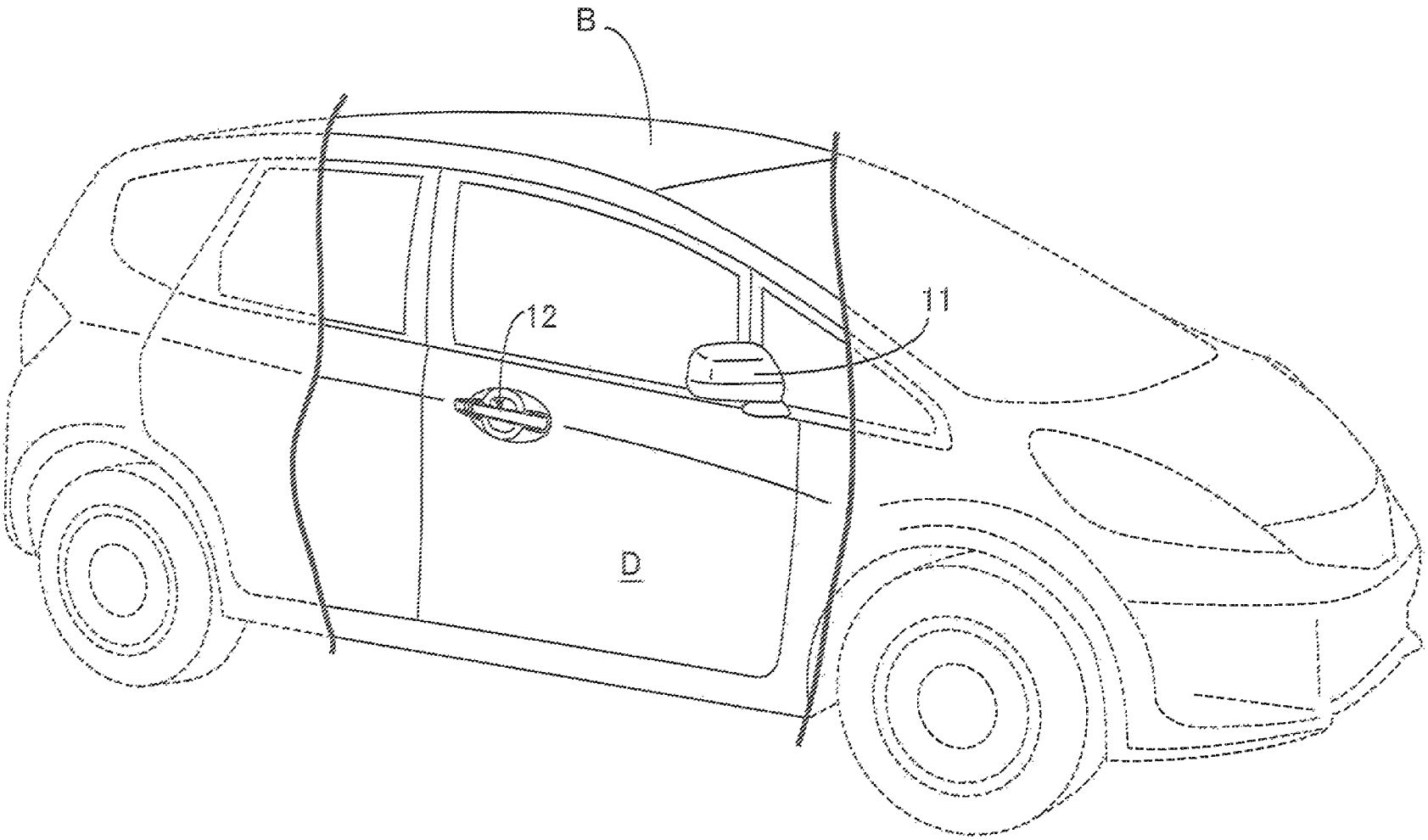
FIG. 1 is a perspective view of a passenger vehicle of a first embodiment.
Figure 2:
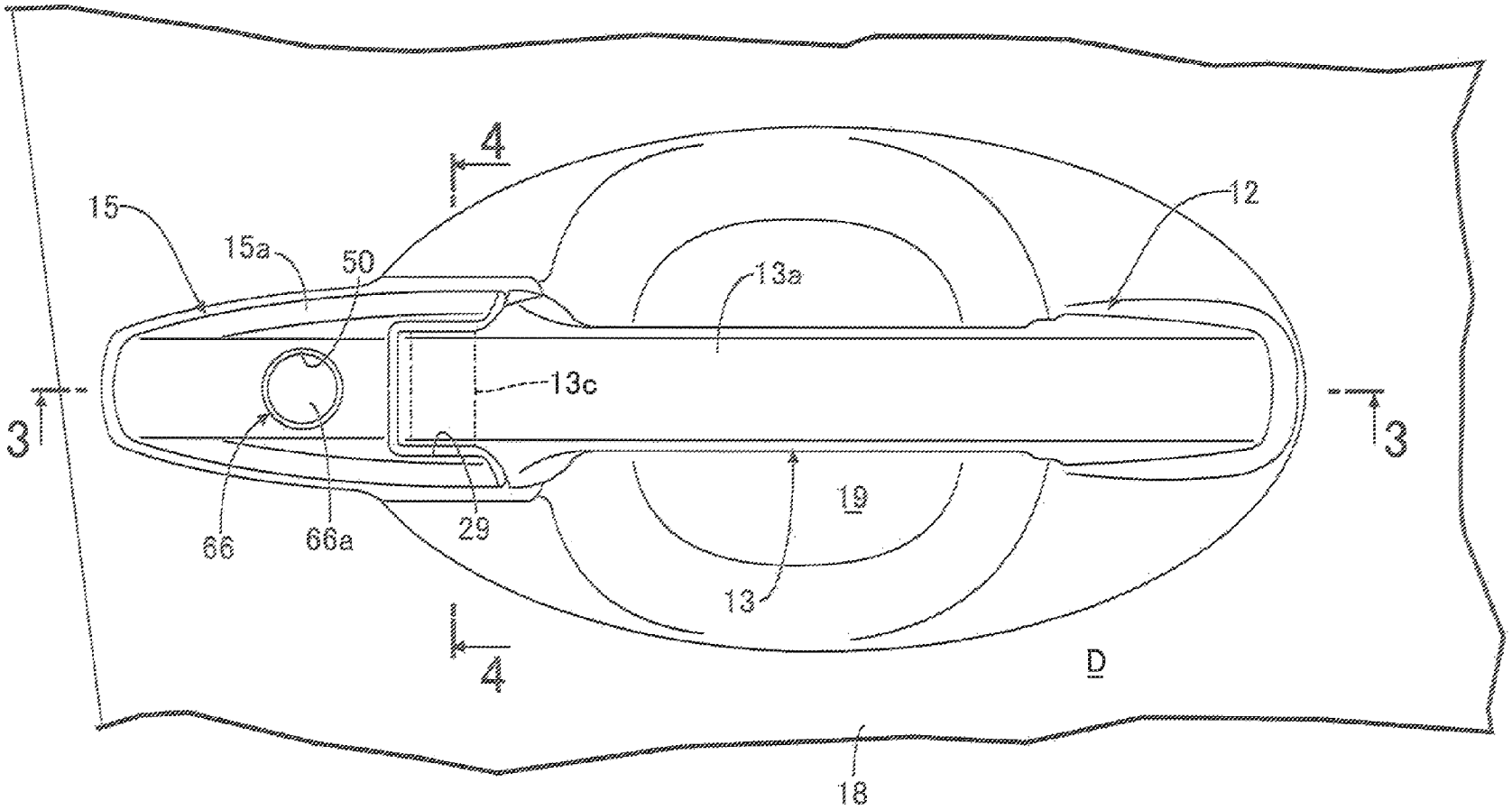
FIG. 2 is a side view showing an essential part of the passenger vehicle shown in FIG. 1 in an enlarged manner.
Figure 3:
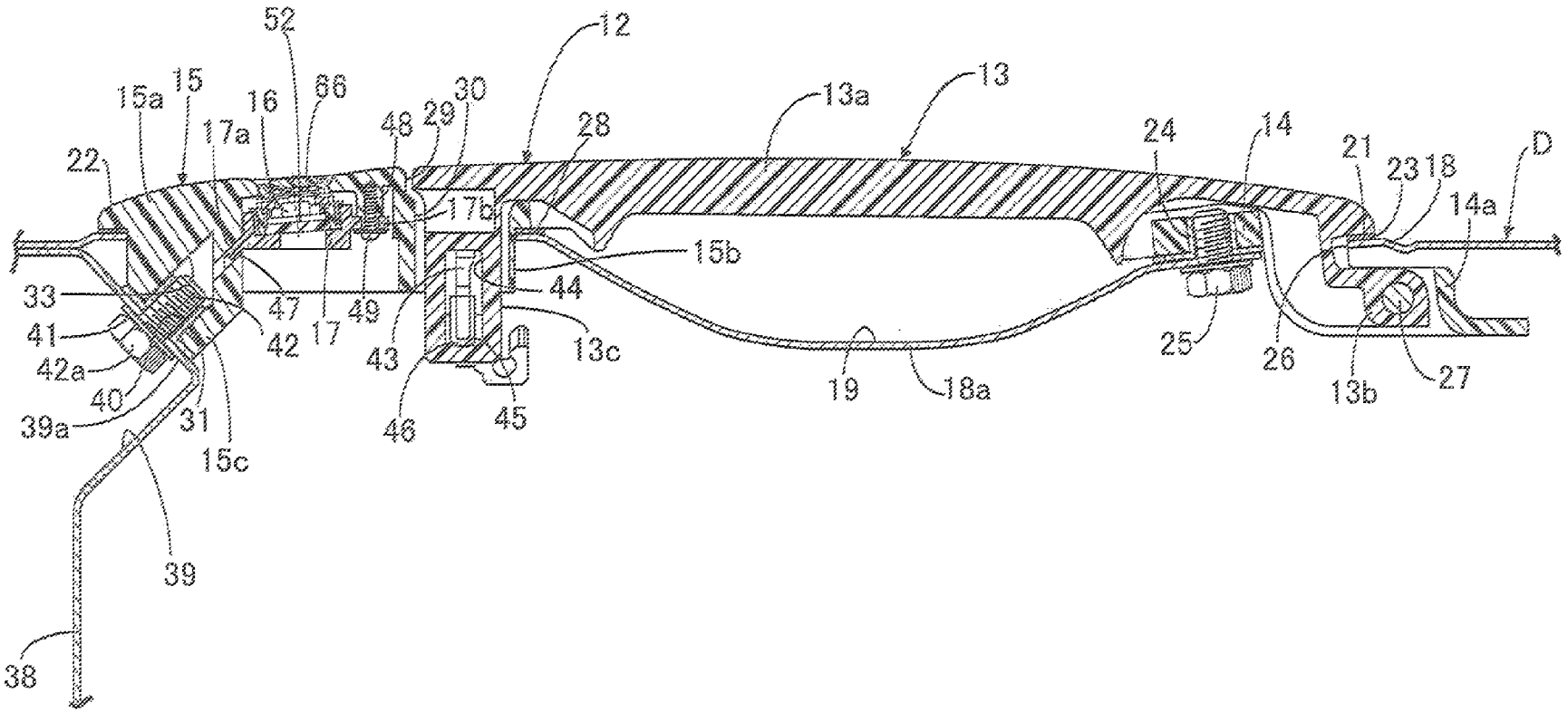
FIG. 3 is a sectional view taken along a line 3-3 in FIG. 2.

Referring to FIG. 2 and FIG. 3 together, the outer handle system 12 includes: a manipulation handle 13; a support member 14 attached to the door D in a way that rotatably supports one end portion of the manipulation handle 13; a base member 15 made of synthetic resin, and attached to the door D to correspond to the other end portion of the manipulation handle 13; and a switch supporting member 17 attached to the base member 15 in a way that supports a switch 16 which is designed to turn on and off in accordance with the manipulation of a user of the vehicle in order for the user to show at least one of an intention of locking the door D and an intention of unlocking the door D.

The manipulation handle 13 is rotatably supported by an outer panel 18 constituting part of the door D. The manipulation handle 13 includes: a grip portion 13*a* enabling the user of the vehicle to take hold of the grip portion 13*a*, and extending in a front-rear direction of the vehicle (in a left-right direction in FIG. 2) to be formed long, as well as being placed in the outside of the outer panel 18; a support arm portion 13*b* installed integral with and continuous to one end portion of the grip portion 13*a* (in this embodiment, a front end portion of the grip portion 13*a* in the front-rear direction of the vehicle); and a guide arm portion 13*c* installed integral with and continuous to the other end portion of the grip portion 13*a* (in this embodiment, a rear end portion of the grip portion 13*a* in the front-rear direction of the vehicle). The manipulation handle 13 is made of hard synthetic resin.

Furthermore, the support member 14 made of hard synthetic resin is attached to a portion of the outer panel 18 on one end side of the manipulation handle 13. The base member 15 made of hard synthetic resin is attached to another portion of the outer panel 18 on the other end side of the manipulation handle 13.

A curve portion 18*a* for forming a dent 19 which enables the user of the vehicle to insert a hand between the grip portion 13*a* of the manipulation handle 13 and the outer panel 18 is provided to the outer panel 18 in a way that expands inwards. First and second attachment seats 21, 22 are provided to front and rear areas of an outer surface of the outer panel 18 in the front-rear direction, with the curve portion 18*a* interposed between the front and rear areas thereof.

A synthetic resin-made first sealing member 23, formed of a thin flat plate shape, is installed between the support member 14 and the first attachment seat 21. In addition, a handle supporting portion 14*a*, which penetrates the first sealing member 23 and the outer panel 18 as well as is inserted into the inside of the outer panel 18, is provided integral with the support member 14. Furthermore, a first nut 24 made of metal is embedded in a surface of the support member 14 which faces the outer panel 18. The support member 14 is attached to the first attachment seat 21 of the outer panel 18 by screwing and fastening a first bolt 25, which is inserted from the inner side into the outer panel 18, to the first nut 24.

The support arm portion 13*b* is of a shape bent to form substantially L-shape, and is installed integral with and continuous to the one end portion of the grip portion 13*a*. A first through-hole 26 through which to insert the support arm portion 13*b* into the inside of the outer panel 18 is provided to the first attachment seat 21 of the outer panel 18 and the support member 14. The support arm portion 13*b* placed in the inside of the handle supporting portion 14*a* is rotatably supported by the handle supporting portion 14*a* with the assistance of a support pin 27. In other words, the one end portion of the manipulation handle 13 is rotatably supported by the outer panel 18 with the assistance of the support member 14.

The base member 15 is made of hard synthetic resin. The base member 15 integrally includes: a base member main portion 15*a* placed in the outside of the second attachment seat 22 of the outer panel 18; a guide portion 15*b* extending from the front portion of the base member main portion 15*a* towards the inside of the outer panel 18 in a way that guides the guide arm portion 13*c* which is installed continuous to the other end portion of the grip portion 13*a* of the manipulation handle 13 to form a substantially right angle with the grip portion 13*a*; and an attached portion 15*c* extending from the rear portion of the base member main portion 15*a* towards the inside of the outer panel 18. A second sealing member 28 made of elastic material such as rubber or synthetic resin, and formed of a thin flat plate shape, is installed between at least the peripheral edge portion of the base member main portion 15*a* and the second attachment seat 22.

A reception recess portion 29 for receiving the other end portion of the grip portion 13*a* is provided in one end portion, on the dent 19 side, namely a front end portion, of the base member main portion 15*a* of the base member 15. Thereby, the base member main portion 15*a* is formed in a shape which looks as if the grip portion 13*a* and the base member main portion 15*a* are unitary while the other end portion of the grip portion 13*a* is received by the reception recess portion 29. A rectangular insertion hole 30 into which to insert the guide arm portion 13*c* is provided in the reception recess portion 29 of the base member main portion 15*a*. The guide portion 15*b* is formed of a squared tubular shape, and continuous to the insertion hole 30.

The attached portion 15*e* is attached to an end wall 38 of the door D, on the other end side, namely a rear end side, of the door D. This attached portion 15*c* is provided with a closed-end attachment hole 33 extending in a direction which makes the attachment hole 33 obliquely intersects the outer panel 18 with an axis of the attachment hole 33 tilting in a way that becomes farther from the outer panel 18 towards the rear of the vehicle. A second nut 31 is fixed to an end portion of the opening of the attachment hole 33 by being press-fitted into the opening.

On the other hand, a recess portion 39, which corresponds to the attached portion 15*c* and is bent frontwards, is provided to the rear end-side end wall 38 of the door D. The recess portion 39 is formed in a way that makes a closed end of the recess portion 39 have a support plate portion 39*a* which is in contact with a tip end of the attached portion 15*c*, namely, the second nut 31. In addition, an insertion hole 40 corresponding to the second nut 31 is provided to the support plate portion 39*a*, The base member 15 is attached to the door D by: inserting a second bolt 42 having an expanded-diameter head portion 42*a* into the insertion hole 40 while causing the second bolt 42 to engage with the support plate portion 39*a* with a washer 41 interposed between the expanded-diameter head portion 42*a* and the support plate portion 39*a*; and screwing and fastening the second bolt 42 to the second nut 31.

The guide arm portion 13*c* integrally included in the manipulation handle 13 is inserted into the inside of the guide portion 15*b* through the insertion hole 30 of the base member 15 in a way that is movable in a direction substantially orthogonal to the outer panel 18. On the other hand, a lever 43 rotatable about an axis orthogonal to a rotational axis of the manipulation handle 13 is rotatably supported by the base member 15. One end portion of the lever 43 is inserted into the inside of an opening portion 44 which is provided to the guide arm portion 13*c* of the manipulation handle 13, and which is open towards both the left and right sides of the guide portion 13*c*. In addition, a contact surface 45 which is formed in one sidewall of the opening portion 44 at the tip end side of the guide arm portion 13*c*, and which faces outwards, is formed in the guide arm portion 13*c*. A lever cover 46 which is made of synthetic resin with low coefficient of friction, such as nylon, and which is attached to the one end portion of the lever 43, is made in contact with the contact surface 45 in the inside of the opening portion 44.

Furthermore, a return spring (not illustrated) configured to bias the lever 43, which has the lever cover 46 in contact with the contact surface 45, towards a non-operational position is provided between the lever 43 and the base member 15. The manipulation handle 13 is spring-biased towards an open position by the return spring.

For example, paired engagement holes 47, whose one ends are opened in an inner end closed portion of the closed-end attachment hole 33 provided to the attached portion 15*c*, and which extends in a direction along the axis of the attachment hole 33, are provided to the attached portion 15*c* of the base member 15 in a way that makes the other ends of the paired engagement holes 47 opened in the outer periphery of the attached portion 15*c*. Paired engagement protrusions 17*a* configured to engage respectively with the other end portions of the engagement holes 47 are integrally provided to the switch supporting member 17. Moreover, an attachment boss 48 is integrally and projectingly provided to the base member main portion 15*a* of the base member 15 on the opposite side of the switch supporting member 17 from the attached portion 15*c*. A support protrusion 17*b* integrally provided to the switch supporting member 17 in a way that extends outwards is fastened to the attachment boss 48 by use of a screw member 49. In other words, the switch supporting member 17 is fastened to the base member 15 by use of the screw member 49 with the engagement protrusions 17*a* engaging with the respective engagement holes 47, and the switch supporting member 17 is thereby fixed to an inner surface side of the base member 15 between the guide portion 15*b* and the attached portion 15*c*.

Figure 4:
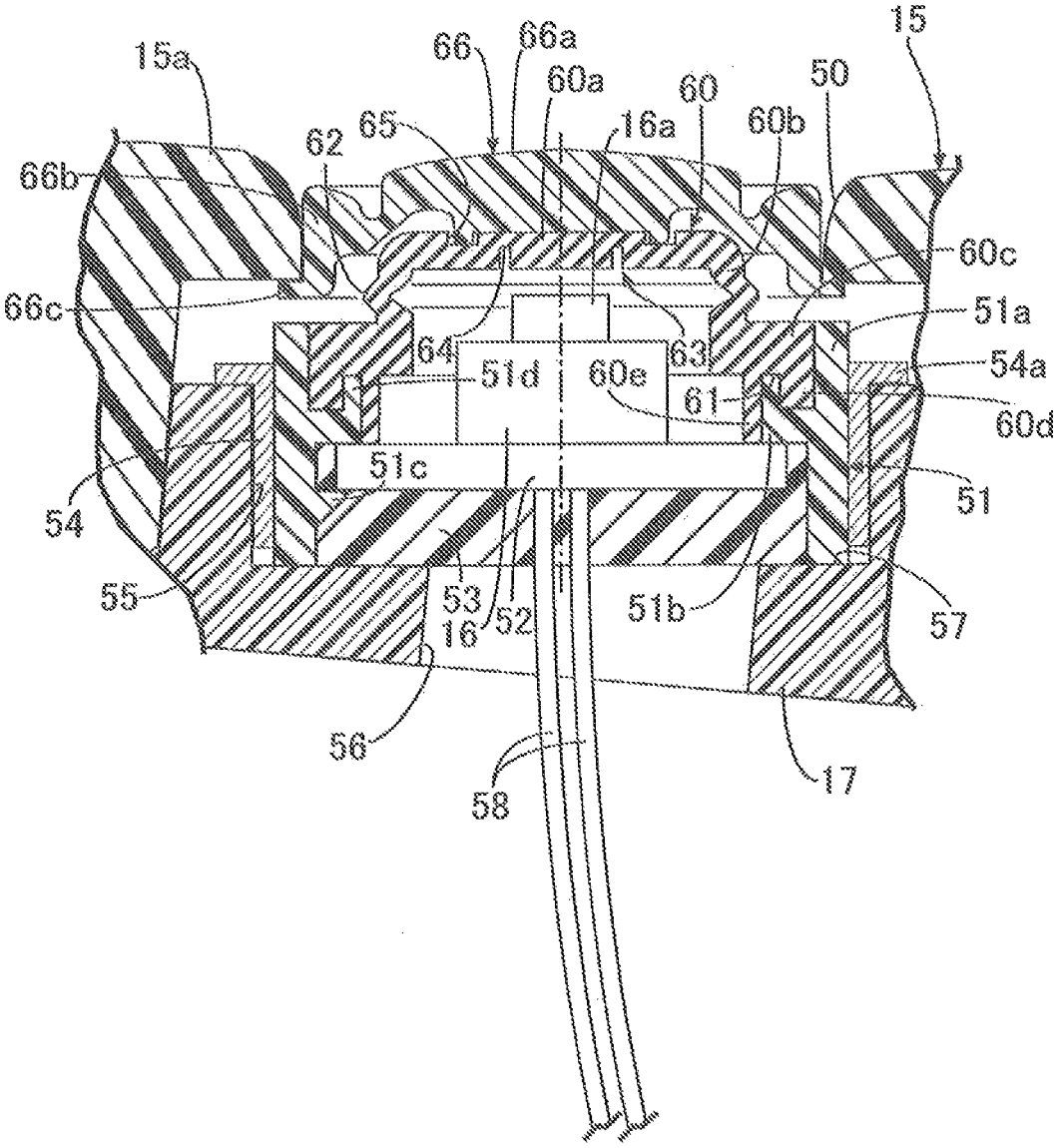
FIG. 4 is an enlarged sectional view taken along a line 4-4 in FIG. 2.

Referring to FIG. 4 together, the base member 15 fulfills a function as a switch housing case. A circular opening portion 50 is provided to a portion of the base member main portion 15*a* of the base member 15 which corresponds to the switch supporting member 17. In addition, a holder 51, which is placed in the inside of the base member main portion 15*a* of the base member 15, is fixed to the base member main portion 15*a* in a position corresponding to the opening portion 50 with the switch supporting member 17 interposed between the holder 51 and the base member main portion 15*a*. The holder 51 includes a holder main portion 51*a* which is formed of a tubular shape, and at least one end of the holder main portion 51*a* on the opening portion 50 side is opened. In this embodiment, the holder 51 includes the holder main portion 51*a* which is formed of a cylindrical shape, and opposite ends are opened.

The holder 51 integrally includes: the holder main portion 51*a;* and an inward collar portion 51*b* projecting inwards in a radial direction from an inner surface of an intermediate portion, in the axial direction, of the holder main portion 51*a*. The switch 16 is fixed to a disc-shaped base plate 52 whose outer peripheral portion is in contact with the peripheral edge portion of the inward collar portion 51*a* from a side opposite to the opening portion 50. Temporarily-fixing protrusions 51*c* are integrally and projectingly provided, respectively, to multiple areas of the inner surface of the holder main portion 51*a* in the peripheral direction. Multiple areas of an outer peripheral portion of the base plate 52 in the peripheral, direction are interposed between the temporarily-fixing protrusions 51*c* and an inner peripheral portion of the inward collar portion 51*b*. In addition, the base plate 52 is fixed to the inside of the holder main portion 51*a* of the holder 51 by filling a potting agent 53 into the inside of the holder main portion 51*a* from the other end portion-side of the holder main portion 51*a* in a temporarily-fixed state in which the multiple areas of the outer peripheral portion of the base plate 52 in the peripheral direction are interposed between the inner peripheral portion of the inward collar portion 51*b* and the temporarily-fixing protrusions 51*c*. The switch 16 is thereby housed in and fixed to the inside of the holder main portion 51*a* as well. In this respect, the switch 16 has a portion to be pressed 16*a* in the center of an opposite end portion of the switch 16 from the base plate 52, and is fixed to the base plate 52 in a way that changes the switching mode of the switch 16 in accordance with the action of pressing force to be applied to the portion to be pressed 16*a*.

The holder main portion 51*a* is fitted into a cylinder-shaped reinforcement member 54 made of rigid material. This reinforcement member 54 is press-fitted into the switch supporting member 17. To put it specifically, a large-diameter hole 55 on the opening portion 50 side and a small-diameter hole 56 which is smaller in diameter than the large-diameter hole 56 are coaxially provided to the switch supporting member 17 in a way that forms an annular step portion 57 between the large-diameter hole 55 and the small-diameter hole 56. The reinforcement member 54 is press-fitted into the large-diameter hole 55 in a way that makes the other end of the holder main portion 51*a* in contact with the annular step portion 57. A collar portion 54*a*, which is in contact with the peripheral edge of an opposite end portion of the large-diameter hole 55 from the smaller-diameter hole 56, is integrally provided to an end portion of the reinforcement member 54 on the opening portion 50 side in a way that extends outwards in the radial direction. Thus, the holder 51 is fixed to the inside of the base member main portion 15*a* of the base member 15 with an end portion of the holder main portion 51*a* opposed to an inner surface of the peripheral edge portion of the opening portion 50. Furthermore, electrical wires 58 extending from the base plate 52 are drawn out of the switch supporting member 17 through the small-diameter hole 56.

An intermediate cap 60 made of elastic material is joined to the holder 51 in a way that closes one end of the holder main portion 51*a* of the holder 51. This intermediate cap 60 integrally includes: a lid portion 60*a* covering the switch 16 in a way that enables the pressing force to act on the portion to be pressed 16*a* of the switch 16; a tubular portion 60*b* which is formed of a cylindrical shape, and whose one end continues to the peripheral edge portion of the lid portion 60*a;* a collar portion 60*c* extending outward in the radial direction from the other end of the tubular portion 60*b;* an outer tubular portion 60*d* formed of a cylindrical shape, and projecting, in a direction opposite to the lid portion 60*a,* from the outer periphery of the collar portion 60*c;* and an inner tubular portion 60*e* formed of a cylindrical shape, and projecting, in the same direction as does the outer tubular portion 60*d,* from an intermediate portion of the collar portion 60*c* in the radial direction in a way that forms an annular recess portion 61 between the inner tubular portion 60*e* and the outer tubular portion 60*d*. The amount of projection of the inner tubular portion 60*e* from the collar portion 60*e* is set larger than the amount of projection of the outer tubular portion 60*d* from the collar portion 60*c*.

Accordingly, the intermediate cap 60 is attached to the holder 51 by inserting and joining an end portion, opposite from the lid portion 60*a*, of the intermediate cap 60 to the one end portion of the holder main portion 51*a* of the holder 51. While no pressing manipulation force acts on the intermediate cap 60 joined to the holder 51, the lid portion 60*a* is situated away from the portion to be pressed 16*a* of the switch 16, as show in FIG. 4.

The intermediate cap 60 has the collar portion 60*c,* the outer tubular portion 60*d* and the inner tubular portion 60*e* in the end portion, opposite from the lid portion 60*a,* of the intermediate cap 60. For this reason, when the holder 51 is molded in a way that the end portion, opposite from the lid portion 60*a,* of the intermediate cap 60 is inserted and joined to the holder 51, the inner periphery on the one end side of the holder main portion 51*a* is defined by the outer periphery of the outer tubular portion 60*d;* a surface on the opening portion 50 side of the inward collar portion 51*b* and the inner periphery of the inward collar portion 51*b* are defined by the outer tubular portion 60*d* and the inner tubular portion 60*e;* and an annular protrusion 51*d*, which projects from an inner peripheral portion of the inward collar portion 51*b* in a way that enters the annular recess portion 61 between the outer tubular portion 60*d* and the inner tubular portion 60*e,* is integrally formed in the holder 51.

In other words, the end portion, opposite from the lid portion 60*a,* of the intermediate cap 60 is inserted and joined to the one end portion of the holder main portion 51*a* included in the holder 51 in a way that engages their recess and protrusion with each other.

In addition, for the purpose of preventing water from entering the inside of the holder 51 through the gap between the intermediate cap 60 and the holder 51, the intermediate cap 60 and the holder 51 are formed from materials in combination which enables the intermediate cap 60 and the holder 51 to get into close contact with each other by hydrogen bond involved with their insertion join. In this embodiment, the holder 51 is made of polyester-based resin such as polybutylene terephthalate (PBT), etc. while the intermediate cap 60 is made of thermoplastic polyester elastomer (ester-ether type). Accordingly, by the insertion join, the interfacial boundary of the holder 51 and the interfacial boundary of the intermediate cap 60 get into close contact with each other through hydrogen bond between the C═O group of the material made into the holder 51 and the OH group of the material made into the intermediate cap 60.

Furthermore, for the purpose of preventing water from entering the inside of the holder 51 through the gap between the potting agent 53 and the holder 51, material which makes hydrogen bond with the holder main portion 51*a* of the holder 51 is selected as the potting agent 53. In this embodiment, the potting agent 53 is urethane.

Figure 5:
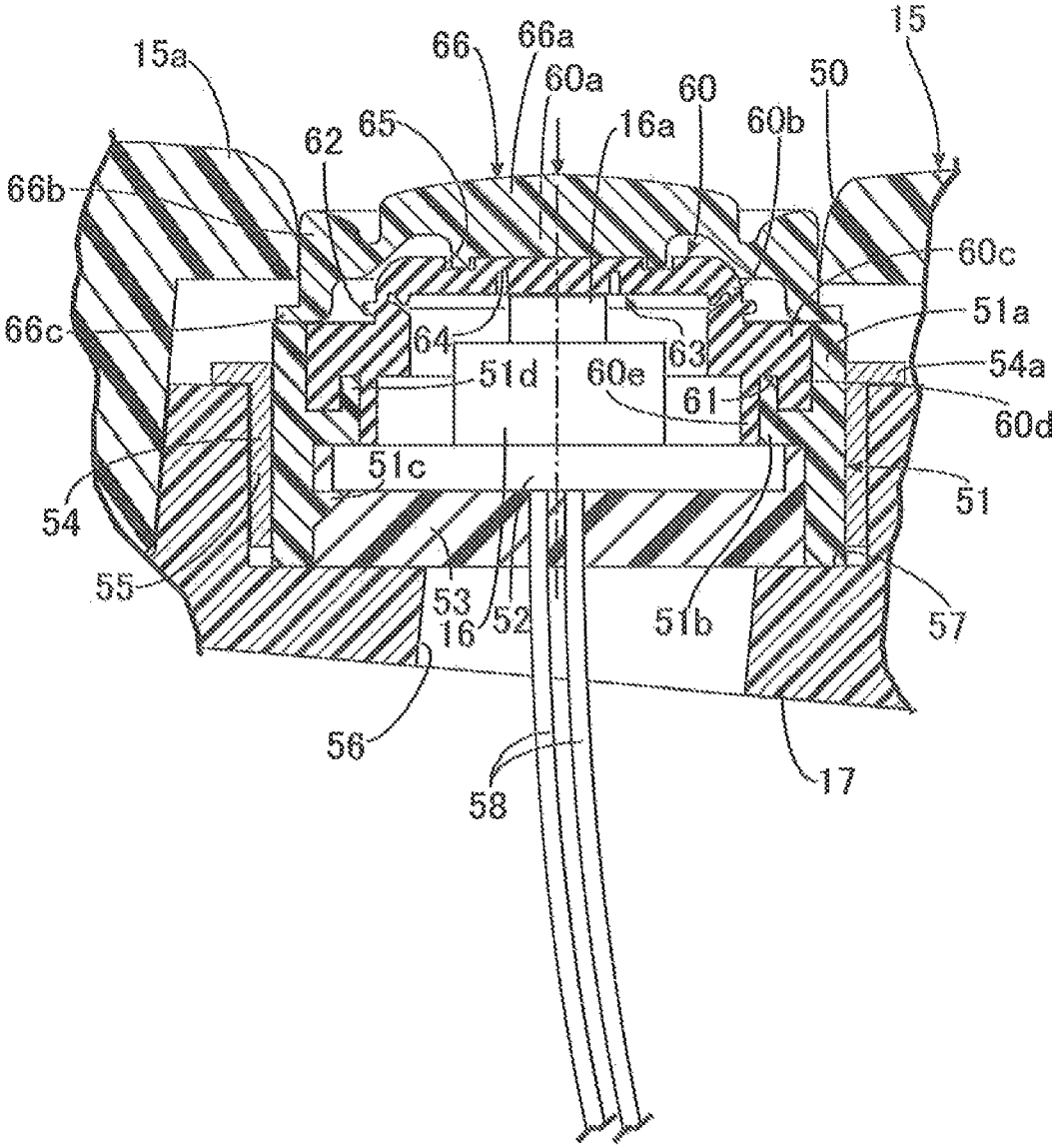
FIG. 5 is a sectional view corresponding to FIG. 6 in a state where a first switch button is pressed.

The tubular portion 60*b* of the intermediate cap 60 is provided with a first deformation portion 62 configured to deform the tubular portion 60*b* in order for the lid portion 60*a* as a whole to press the portion to be pressed 16*a* of the switch 16 in accordance with the action of the pressing force from a first switch button 66 shown in FIGS. 4 and 5 on the lid portion 60*a*. The lid portion 60*a* is provided with a second deformation portion 63 configured to deform a center portion of the lid portion 60*a* in order for the center portion of the lid portion 60*a* to press the, portion to be pressed 16*a* of the switch 16 in accordance with the action of the pressing force from a second switch button 67 shown in FIG. 6 and FIG. 7 on the center portion of the lid portion 60*a*.

The first deformation portion 62 is formed of an accordion shape in a way that makes an intermediate portion of the tubular portion 60*b* in the axial direction project outwards in the radial direction. Moreover, the second deformation portion 63 includes: a first annular groove 64 formed in an inner surface of the center portion of the lid portion 60*a;* and a second annular groove 65 larger in diameter than the first annular groove 64, formed in an outer surface of the center portion of the lid portion 60*a,* and coaxial with the first annular groove 64.

The first switch button 66 integrally includes: a closed-end cylindrical portion 66*b* having a press manipulation portion 66*a,* which is placed inside the opening portion 50 of the base member 15, in a closed portion of one end of the closed-end cylindrical portion 66*b;* and a first collar portion 66*c* extending outwards in the radial direction from an opening edge of the other end of the closed-end cylindrical portion 66*b*. The first switch button 66 is made of rigid synthetic resin. In addition, the first collar portion 66*c,* which the first switch button 66 has in the outer periphery of one end portion on the holder 51 side of the first switch button 66, is placed between the one end portion of the holder main portion 51*a* of the holder 51 and an inner surface of a peripheral edge portion of the opening portion 50. The first collar portion 66*c* is movable between the one end portion of the holder main portion 51*a* and the inner surface of the peripheral edge portion of the opening portion 50.

Meanwhile, an inner surface of a center portion of the press manipulation portion 66*a* of the first switch button 66 is always in contact with the center portion of the lid portion 60*a* of the intermediate cap 60. Elastic force exerted by the intermediate cap 60 biases the first switch button 66 toward an unmanipulated position in which the first collar 66*c* is made in contact with the inner surface of the peripheral edge portion of the opening portion 50, as shown in FIG. 4.

In FIG. 5, once the press manipulation force acts on the press manipulation portion 66*a* of the first switch button 66, the entirety of the first switch button 66 moves until the first collar portion 66*c* gets into contact with the one end of the holder main portion 51*a,* of the holder 51. Thereby, the tubular portion 60*b* provided with the first deformation portion 62 deforms in a way that the entirety of the lid portion 60*a* in contact with the press manipulation portion 66*a* presses the portion to be pressed 16*a* of the switch 16.

Figure 6:
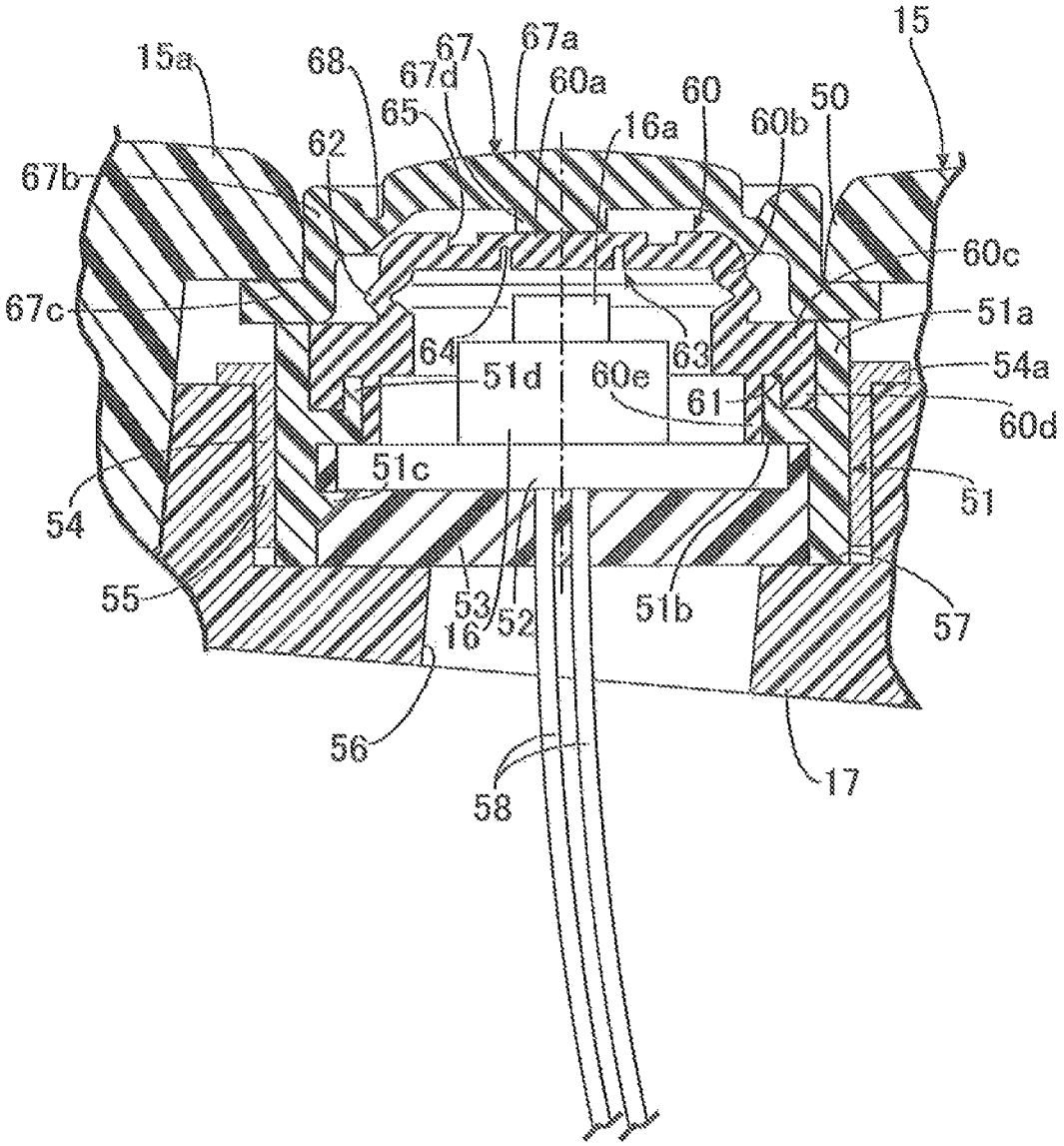
FIG. 6 is a sectional view corresponding to FIG. 4 in a state where a second switch button, a replacement for the first switch button, is not pressed.

In FIG. 6, the second switch button 67 integrally includes: a closed-end cylindrical portion 67*b* having a press manipulation portion 67*a,* which is placed inside the opening portion 50 of the base member 15, in a closed portion of one end of the closed-end cylindrical portion 67*b;* and a second collar portion 67*c* extending outwards in the radial direction from an opening edge of the other end of the closed-end cylindrical portion 67*b*. The second switch button 67 is made of elastic material such as rubber. In addition, the second collar portion 67*c*, which the second switch button 67 has in the outer periphery of one end portion on the holder 51 side of the second switch button 67, is held between and by the one end portion of the holder main portion 51*a* of the holder 51 and the inner surface of the peripheral edge portion of the opening portion 50.

In addition, a protrusion 67*d,* which is always in contact with a center portion of the lid portion 60*a* of the intermediate cap 60, is integrally and projectingly provided to an inner surface of the press manipulation portion 67*a* of the second switch button 67. An annular groove 68 is provided to an outer surface of the closed portion of the one end of the closed-end cylindrical portion 67*b* in a way that surrounds the press manipulation portion 67*a*. In this respect, once the press manipulation force is applied to the press manipulation portion 67*a,* the annular groove 68 facilitates the deformation of the press manipulation portion 67*a* in a way that deforms inwards while the second collar 67*c* is held between and by the one end portion of the holder main portion 51*a* and the inner surface of the peripheral edge portion of the opening portion 50.

Figure 7:
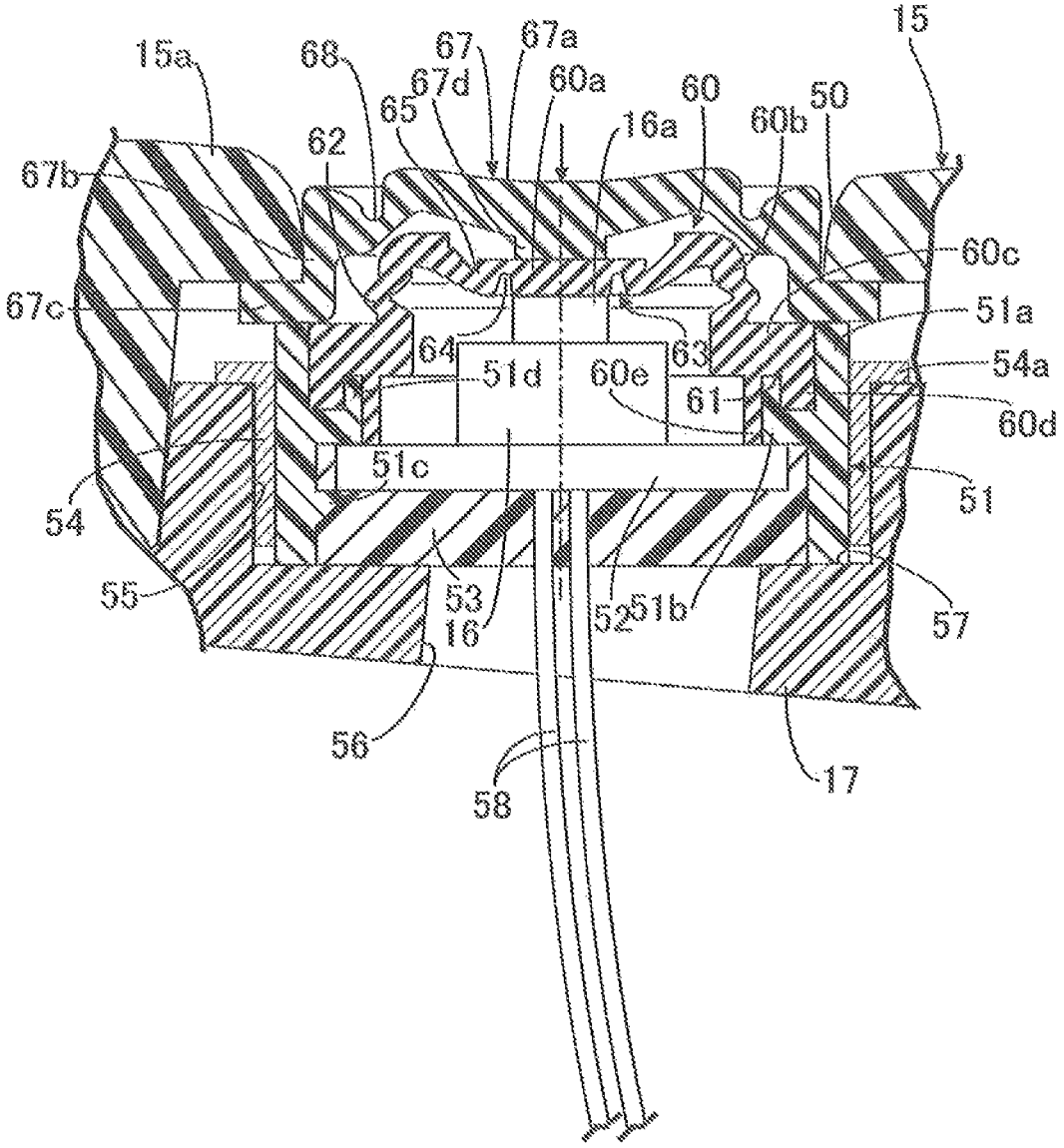
FIG. 7 is a sectional view corresponding to FIG. 5 in a state where the second switch button is pressed.

In FIG. 7, once the press manipulations force acts on the press manipulation portion 67*a* of the second switch button 67, only the press manipulation portion 67*a* of the second switch button 67 deforms in a way that makes the protrusion 67*d* press the center portion of the lid portion 60*a*. Thereby, the center portion of the lid portion 60*a* provided with the second deformation portion 63 deforms in a way that presses the portion to be pressed 16*a* of the switch 16.

Next, descriptions will be provided for operations of the embodiment. The holder 51 including the tubular holder main portion 51*a,* which the switch 16 is housed in and fixed to, is fixed to the inside of the base member 15 with the one end portion of the holder main portion 51*a* opposed to the inner surface of the peripheral edge portion of the opening portion 50 provided in the base member main portion 15*a* of the base member 15. The intermediate cap 60 made of the elastic material, which integrally includes the lid portion 60*a* covering the switch 16 and the tubular portion 60*b* continuing to the peripheral edge portion of the lid portion 60*a,* is attached to the holder 51. The first collar portion 66*c* included in the first switch button 66 is movable between the one end portion of the holder main portion 51*a* and the inner surface of the peripheral edge portion of the opening portion 50. The second collar portion 67*c* included in the second switch button 67 is held between and by the one end portion of the holder main portion 51*a* and the inner surface of the peripheral edge portion of the opening portion 50. The tubular portion 60*b* is provided with the first deformation portion 62 which is configured to deform the tubular portion 60*b* in the way that the entirety of the lid portion 60*a* presses the switch in accordance with the action of the pressing force on the lid portion 60*a* from the first switch button 66 the entirety of which moves in accordance with the press manipulation to the press manipulation portion 66*a*. The lid portion 60*a* is provided with the second deformation portion 63 which is configured to deform the center portion of the lid portion 60*a* in the way that makes the center portion of the lid portion 60*a* press the switch 16 in accordance with the pressing force which acts on the center portion of the Rd portion 60*a* from the press manipulation portion 67*a* of the second switch button 67 in accordance with the press manipulation. For these reasons, it is possible to deal with the two types of switch buttons, namely, the first switch button 66 the entirety of which moves in accordance with the press manipulation, and the second switch button 67 in which only the press manipulation portion 67*a* deforms in accordance with the press manipulation, without making changes to the parts exclusive of these switch buttons 66, 67. Accordingly, it is possible to enhance the design quality.

In addition, the end portion opposite from the lid portion 60*a* of the intermediate cap 60 is inserted in and joined to the one end portion of the holder main portion 51*a* included in the holder 51, and the intermediate cap 60 and the holder main portion 51*a* engage with each other in the way that engages their recess and protrusion with each other. For these reasons, even if a gap should occur in the joining portion between the intermediate cap 60 and the holder main portion 51*a*, the gap is labyrinthine. Accordingly, it is possible to suppress the entrance of water from the outside of the holder 51 to the switch 16 side within the holder 51.

Moreover, because the intermediate cap 60 and the holder 51 get into close contact with each other due to the hydrogen bond, it is possible to prevent water from entering the inside of the holder 51 more securely.

Furthermore, because the switch device is constructed by using the base member 15, which is attached to the outer panel 18, as the switch housing case, the switch device of the present invention can be adequately used for the vehicle door outer handle system 12.

An embodiment of the present invention has been described hereinabove. However, the present invention is not limited to the above embodiment, but various design changes are possible without departing from the gist of the present invention.

For example, the foregoing descriptions have been provided for the embodiment in which, the base member 15 is used as a switch housing case. However, the manipulation handle 13, which includes the grip portion 13*a* placed on the outside of the outer panel 18 constituting part of the door D and formed long, may be used as a switch housing case.

Further, the foregoing descriptions have been provided for the embodiment in which the holder 51, the base plate 52, the intermediate cap 60, and the first and second switch buttons 66, 67 are formed of a cylindrical shape or a circular shape. However, the shapes of these members 51, 52, 60, 66, 67 are not limited to the cylindrical or circular shape. The shapes of these members 51, 52, 60, 66, 67 may be formed, for example, of a square tubular shape or a square shape, or a substantially square tubular shape or a substantially square shape whose corners are arch-shaped in cross section. Further, a combination may be employed in which: the holder 51 is formed of a substantially square tubular shape; the base plate 52 is formed of a substantially square shape; the first and second switch buttons 66, 67 are each formed of a circular shape; the lid portion 60*a* of the intermediate cap 60 is formed of a circular shape; the collar portion 60*c* of the intermediate cap 60 is formed of a substantially square shape; the contour of the switch device is formed of a substantially square shape; and the switch press portion is formed of a circular shape.

What is claimed is:

1. A switch device, comprising:

a switch housing case having an opening portion;

a holder, including a tubular holder main portion, fixedly placed inside the switch housing case in a position corresponding to the opening portion, at least one end, on the opening portion side, of the holder main portion being open;

a switch, including a portion to be pressed, housed in and fixed inside the holder main portion of the holder for changing a switching mode in response to a pressing force on the portion to be pressed;

at least one switch button configured to: include a press manipulation portion placed inside the opening portion, make the pressing force act on the switch in accordance with a manipulation of the press manipulation portion, and cover one end portion of the holder main portion, wherein the holder is fixed to the inside of the switch housing case with the one end portion of the holder main portion opposed to an inner surface of a peripheral edge portion of the opening portion; and an intermediate cap made of elastic material is attached to the holder to close one end of the holder main portion and integrally includes a lid portion and a tubular portion, the lid portion being configured to cause the pressing force to act on the portion to be pressed and cover the switch, the tubular portion continuing to a peripheral edge portion of the lid portion, wherein the tubular portion includes a first deformation portion configured to deform the tubular portion to make an entirety of the lid portion press the switch in response to detecting at least a portion of the pressing force on the lid portion, and the lid portion includes a second deformation portion configured to deform a center portion of the lid portion to make the center portion of the lid portion press the switch in response to detecting at least a portion of the pressing force on the center portion of the lid portion, and wherein an end portion of the intermediate cap opposite from the lid portion is inserted into and joined to the one end portion of the holder main portion included in the holder by engaging recesses and protrusions of the end portions with each other.

2. The switch device according to claim 1, wherein the intermediate cap and the holder are made of materials in combination which enable the intermediate cap and the holder to attach to each other due to hydrogen bond.

3. A vehicle door outer handle system in which at least one of locking and unlocking of a door is carried out by use of the switch device according to claim 2, wherein the switch device is constructed by using any one of a manipulation handle and a base member as the switch housing case, the manipulation handle including a grip portion which is placed on an outside of an outer panel constituting part of the door and is formed long, the base member being attached to the outer panel corresponding to an end portion of the manipulation handle.

4. A vehicle door outer handle system in which at least one of locking and unlocking of a door is carried out by use of the switch device according to claim 1, wherein the switch device is constructed by using any one of a manipulation handle and a base member as the switch housing case, the manipulation handle including a grip portion which is placed on an outside of an outer panel constituting part of the door and is formed long, the base member being attached to the outer panel corresponding to an end portion of the manipulation handle.

* * * * *